US007568364B1

(12) United States Patent
Buskop

(10) Patent No.: US 7,568,364 B1
(45) Date of Patent: Aug. 4, 2009

(54) ADVERTISING DEVICE FOR PRODUCE AND CANDY VENDORS

(76) Inventor: Jacqueline Evynne Breuninger Buskop, 2241 Del Monte, Houston, TX (US) 77019

( * ) Notice: Subject to any disclaimer, the term of this patent is extended or adjusted under 35 U.S.C. 154(b) by 520 days.

(21) Appl. No.: 10/675,515

(22) Filed: Sep. 30, 2003

Related U.S. Application Data

(60) Provisional application No. 60/414,887, filed on Oct. 1, 2002.

(51) Int. Cl.
*A44C 7/00* (2006.01)
*F21V 21/08* (2006.01)
*A44C 1/00* (2006.01)

(52) U.S. Cl. ..... 63/14.1; 63/40; 63/1.11; 362/104; 362/571

(58) Field of Classification Search ..... 63/1.11, 63/1.13, 14.1, 14.2–14.8, 21, 3, 23, 40, 4; 362/103, 104, 571, 191, 800; 40/541–583
See application file for complete search history.

(56) References Cited

U.S. PATENT DOCUMENTS

| | | | | | |
|---|---|---|---|---|---|
| 20,480 | A | * | 6/1858 | Carpenter | 63/14.2 |
| 107,679 | A | * | 9/1870 | Haberland | 63/14.8 |
| 151,528 | A | * | 6/1874 | Yeoman | 63/14.5 |
| 788,770 | A | * | 5/1905 | Hill et al. | 63/14.3 |
| 2,040,083 | A | * | 5/1936 | Elliott et al. | 63/14.2 |
| 2,138,596 | A | * | 11/1938 | Fassnacht | 63/23 |
| 2,180,726 | A | * | 11/1939 | Bradley | 63/36 |
| 2,244,944 | A | * | 6/1941 | Furlonge | 63/36 |
| 2,546,945 | A | * | 3/1951 | Gaffield | 362/104 |
| 2,611,251 | A | * | 9/1952 | Guth | 63/14.8 |
| 2,694,299 | A | * | 11/1954 | Gray | 63/14.5 |
| 3,383,503 | A | * | 5/1968 | Montgomery | 362/104 |
| 3,624,384 | A | * | 11/1971 | Ledingham et al. | 362/104 |
| 3,689,758 | A | * | 9/1972 | Power | 362/104 |
| 3,739,599 | A | * | 6/1973 | Melone | 63/14.3 |
| 3,814,926 | A | * | 6/1974 | Frasca | 362/104 |
| 3,968,357 | A | * | 7/1976 | Hamilton | 362/104 |
| D242,646 | S | * | 12/1976 | Shorin et al. | D11/2 |
| 4,237,525 | A | * | 12/1980 | Deter | 362/104 |
| 4,271,457 | A | * | 6/1981 | Martin | 362/104 |
| 4,337,504 | A | * | 6/1982 | Simpson | 362/104 |
| 4,802,070 | A | * | 1/1989 | Westmoland | 362/104 |
| 4,827,738 | A | * | 5/1989 | Rothal | 63/14.1 |
| 4,930,052 | A | * | 5/1990 | Beige | 362/104 |
| 5,097,682 | A | * | 3/1992 | Nakamura | 63/14.1 |
| 5,117,338 | A | * | 5/1992 | McCrary | 362/104 |
| 5,146,768 | A | * | 9/1992 | Dichtel | 63/14.8 |
| 5,201,578 | A | * | 4/1993 | Westmoland | 362/104 |
| 5,497,307 | A | * | 3/1996 | Bae et al. | 362/104 |
| 5,676,988 | A | * | 10/1997 | Coleman et al. | 426/134 |
| 5,809,803 | A | * | 9/1998 | Stracuzzi | 63/12 |
| 5,951,158 | A | * | 9/1999 | Upah | 362/571 |
| 6,289,903 | B1 | * | 9/2001 | Haufler | 132/275 |

(Continued)

*Primary Examiner*—Victor Batson
*Assistant Examiner*—David C Reese
(74) *Attorney, Agent, or Firm*—Buskop Law Group, PC; Wendy Buskop

(57) ABSTRACT

The invention is an advertising apparatus for produce and candy vendors made of at least one earring clip with back side and front side for engaging a non-pierced ear, at least one hook secured to the earring clip, and at least one edible food item removably secured to the hook, wherein the edible food item is a fruit, a vegetable, or combinations thereof.

6 Claims, 3 Drawing Sheets

U.S. PATENT DOCUMENTS 6,293,128 B1 * 9/2001 Leufray-Simms ..... 63/23
6,619,816 B1 * 9/2003 Johnson ..... 362/253
6,763,681 B1 * 7/2004 Klundt ..... 63/1.11
6,865,908 B1 * 3/2005 Cheng ..... 63/29.1
7,040,120 B2 * 5/2006 Hunter ..... 63/4
2004/0074258 A1 * 4/2004 Gavara ..... 63/12
2004/0177647 A1 * 9/2004 Dennis ..... 63/29.1

* cited by examiner

ADVERTISING DEVICE FOR PRODUCE AND CANDY VENDORS

The present application claims priority to Provisional U.S. Patent Application Ser. No. 60/414,887 filed Oct. 1, 2002.

FIELD OF THE INVENTION

The present invention relates to a wearable display device for showing food and candy.

BACKGROUND OF THE INVENTION

Kids love candy. Candy sellers need to show off their product with a wearable device. Fruit sellers need to show off their cherries, plums and kiwi fruit with a wearable device. People have needed earrings which show off edible products, particularly wearable earrings that light up.

SUMMARY OF THE INVENTION

The invention is an advertising device for produce vendors or candy vendors comprising: at least one earring clip with a back side and front side for engaging a non-pierced ear; at least one hook secured to the earring clip; at least one edible food item such as candy or fruit or a vegetable or combinations of these items which can be pierced by the hook and removably secured to the hook.

BRIEF DESCRIPTION OF THE DRAWINGS

The present invention will be explained in greater detail with reference to the appended figures, in which.

The present invention is detailed below with reference to the listed Figures.

DETAILED DESCRIPTION OF THE PREFERRED EMBODIMENTS

Before explaining the present invention in detail, it is to be understood that the invention is not limited to the particular embodiments and that it can be practiced or carried out in various ways.

Figure 1:
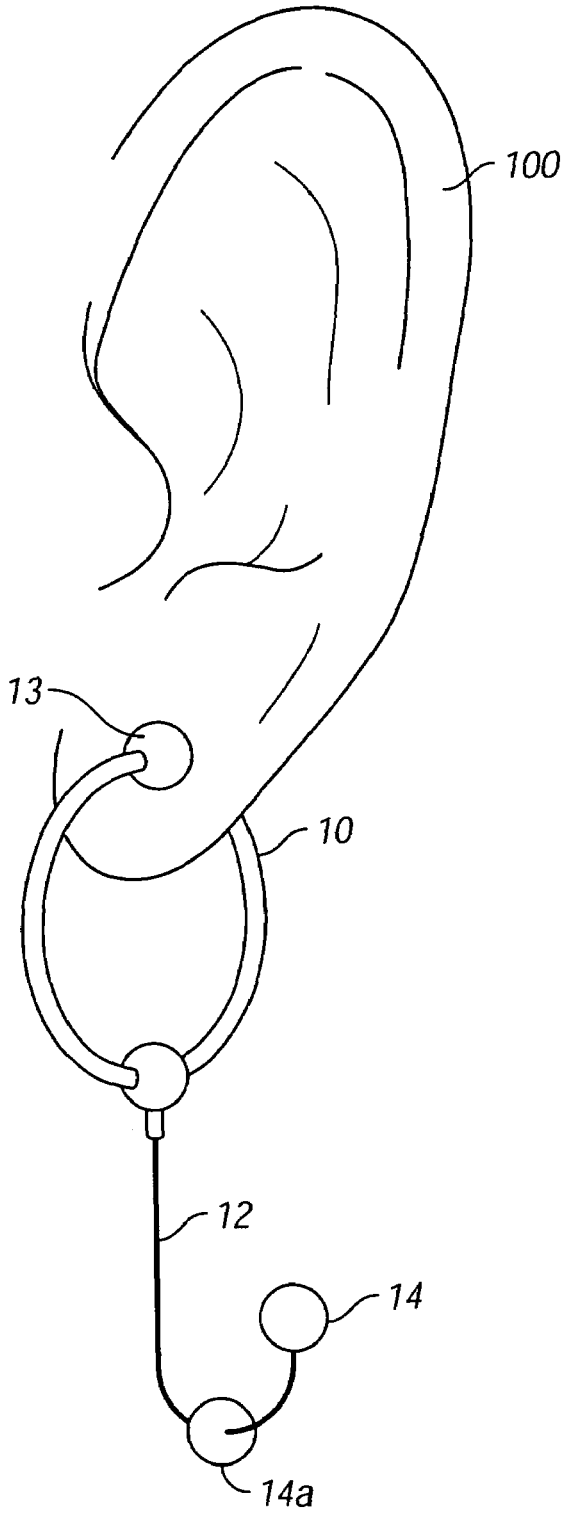
FIG. 1 is a front view of the apparatus secured to an ear with two blueberries attached.

The invention is an advertising apparatus for produce vendors. As shown in FIG. 1, the invention has at least one earring clip (10) with a back side (11) (shown in FIG. 2) and a front side (13) for engaging a non-pierced ear (100). At least one hook (12) is secured to the earring clip (10). At least one edible food item (14) or two food items (14*a*) can be removably secured to the hook (12). The edible food item can be selected from the group: a fruit, a vegetable, candy and combinations thereof.

Figure 2:
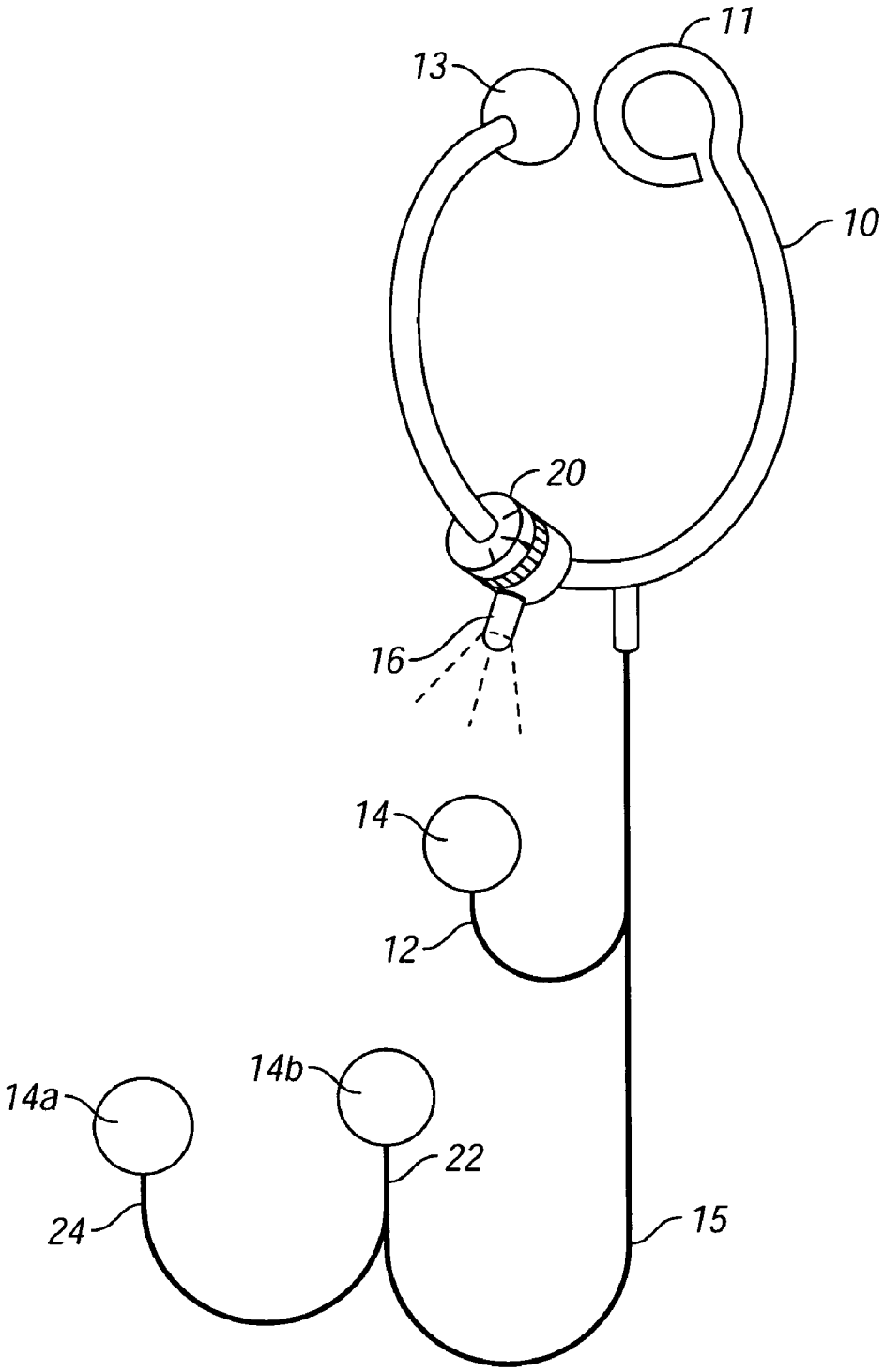
FIG. 2 is a detail view of the apparatus with a two hook embodiment.

FIG. 2 shows that the advertising apparatus can be made from at least two hooks (12) (15) connected in series, but up to three or more hooks can be used.

FIG. 2 shows the second embodiment of the invention, the earring clip can have an LED light (16) secured to the earring clip that automatically lights up the hook (12) in dim light by a switch (20) secured to the earring clip. Alternatively, the LED light (16) can be a blinking LED light. The blinking light version can shine on the food and can attract a buyer's attention to the food on the hook of the earring. In the embodiment of FIG. 2, three food items, (14,) (14*a*) and (14*b*) can be put on each of the hooks, (12), (24) and (22).

FIG. 2 shows the second embodiment of the invention, the earring clip can have an LED light (16) secured to the earring clip that automatically lights up the hook (12) in dim light by a switch (20) secured to the earring clip. Alternatively, the LED light (16) can be a blinking LED light. The blinking light version can shine on the food and can attract a buyer's attention to the food on the hook of the earring. In the embodiment of FIG. 2, three food items, (14,) (14*a*) and (14*b*) can be put on the hooks, (12) and (15).

The invention is not considered to be big. In a preferred embodiment, the hook is between 1.5 inches and 3 inches in overall length. One of the hooks (15) preferably has at least a first prong (22) and a second prong (24) for engaging at least two food items (14*a*, 14*b*).

In still another embodiment of the invention, an advertising apparatus for candy vendors comprises at least one earring clip for engaging a non-pierced ear; at least one hook secured to the earring clip; at least one chewy candy item (26) removably secured to the hook.

Candy that is particularly usable can be soft licorice, soft raspberries, juicy fruits, and similar soft yet pierce able candies.

Figure 3:
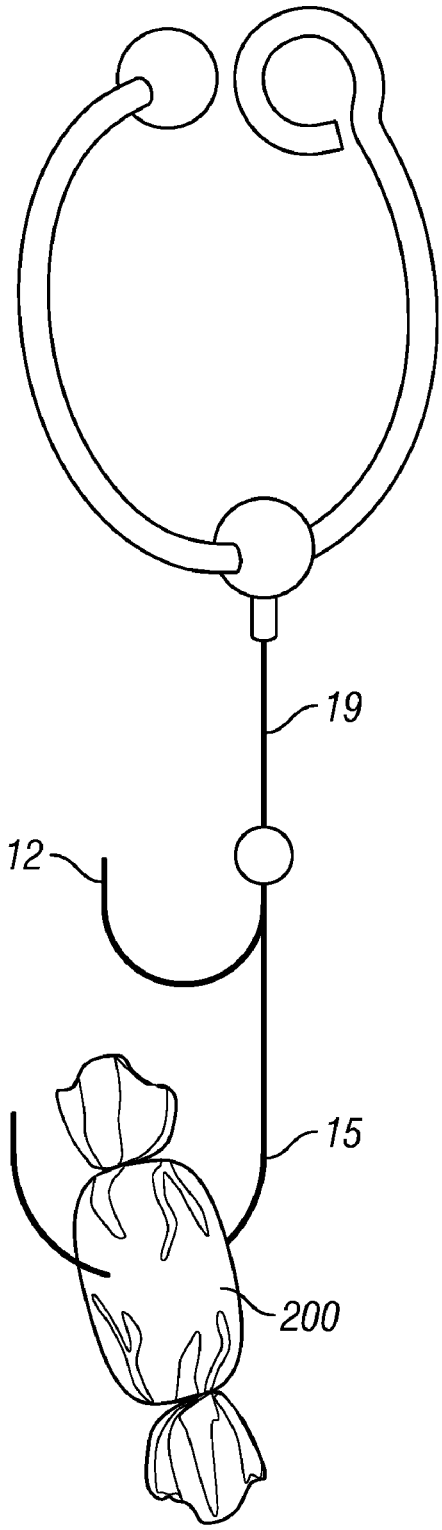
FIG. 3 is a detailed view of the apparatus with candy attached.

FIG. 3 shows still another embodiment of the candy and vegetable display item. The earrings could include a line (19) between the clip and the hook (12). The line is used to connect the hook to the earring clip. Another hook (15) connects to the line further from the earring clip than the first hook (12), such that the hooks are connected in sequence. Candy (200) can be hooked onto one hook (15) or alternatively onto both hooks (12) and (15).

While this invention has been described with emphasis on the preferred embodiments, it should be understood that within the scope of the appended claims, the invention might be practiced other than as specifically described herein.

What is claimed is:

1. An advertising apparatus for produce vendors consisting of a pair of earrings, wherein each earring consists of:

a. an earring clip with a back side and a front side for engaging a non-pierced ear;

b. at least one line axially secured to the at least one earring clip, a first hook axially secured to at least one line; a second hook axially secured to the at least one line between the earring clip and the first hook, wherein the second hook is axially aligned with the first hook, and wherein the first hook and the second hook each have at least a first prong and a second prong respectively, for engaging at least two different edible food items;

c. wherein the at least two different edible food items are removably secured to each hook by at least partially penetrating the at least two different edible food items using each hook, and the at least two different edible food items are selected from a member of the group consisting of: a fruit, a vegetable, and combinations thereof; and d. an automatic LED disposed on a lower portion of the front side for lighting the at least two different edible food items, wherein the automatic LED is electrically insulated from the at least one earring clip, and wherein the automatic LED is a blinking LED light that can be actuated with a switch secured to the at least one earring clip illuminating the at least two different edible food items.

2. The advertising apparatus of claim 1, wherein the first hook and the second hook are each between 1.5 inches and 3 inches in overall length.

3. The advertising apparatus of claim 1, wherein the at least two different edible food items are selected from a member of the group consisting of: blueberries, strawberries, dried fruits, blackberries, cherry tomatoes, kiwi fruits, other fruits, other vegetables, and combinations thereof.

4. An advertising apparatus for candy vendors consisting of a pair of earrings, wherein each earring consists of:

a. an earring clip with a back side and a front side for engaging a non-pierced ear;

b. at least one line axially secured to the at least one earring clip; a first hook axially secured to the at least one line; a second hook axially secured to the at least one line between the at least one earring clip and the first hook, wherein the second hook is axially aligned with the first hook, and wherein the first hook and the second hook each have at least a first prong and a second prong respectively, for engaging at least two different chewy candy items;

c. wherein the at least two different chewy candy items are removably secured to each hook by at least partially penetrating the at least two different chewy candy items using each hook; and d. an automatic LED disposed on a lower portion of the front side for lighting the at least two different chewy candy items, wherein the automatic LED is electrically insulated from the at least one earring clip, and wherein the automatic LED is a blinking LED light that can be actuated with a switch secured to the at least one earring clip illuminating the at least two different chewy candy items.

5. The advertising apparatus of claim 4, wherein the at least two different chewy candy items are selected from a member of the group consisting of: soft licorice, soft raspberries, juicy fruits, and combinations thereof.

6. The advertising apparatus of claim 4, wherein the first hook and the second hook are each between 1.5 inches and 3 inches in overall length.

* * * * *